US011103869B2

(12) United States Patent
Xi et al.

(10) Patent No.: US 11,103,869 B2
(45) Date of Patent: Aug. 31, 2021

(54) MICROFLUIDIC CHIP AND DRIVING METHOD THEREOF AND ANALYSIS APPARATUS

(71) Applicant: Shanghai AVIC OPTO Electronics Co., Ltd., Shanghai (CN)

(72) Inventors: Kerui Xi, Shanghai (CN); Feng Qin, Shanghai (CN); Jine Liu, Shanghai (CN); Xiaohe Li, Shanghai (CN); Tingting Cui, Shanghai (CN)

(73) Assignee: Shanghai AVIC OPTO Electronics Co., Ltd., Shanghai (CN)

( * ) Notice: Subject to any disclaimer, the term of this patent is extended or adjusted under 35 U.S.C. 154(b) by 269 days.

(21) Appl. No.: 16/444,282

(22) Filed: Jun. 18, 2019

(65) Prior Publication Data

US 2020/0306754 A1 Oct. 1, 2020

(30) Foreign Application Priority Data

Mar. 28, 2019 (CN) ..... 201910244503.6

(51) Int. Cl.
*B01L 3/00* (2006.01)

(52) U.S. Cl.
CPC . *B01L 3/502715* (2013.01); *B01L 2300/0645* (2013.01); *B01L 2400/0415* (2013.01)

(58) Field of Classification Search
CPC ..... B01L 2300/0645; B01L 2300/0819; B01L 2300/161; B01L 2400/0415; B01L 2400/0427; B01L 3/502715; B01L 3/50273; B01L 3/502792
See application file for complete search history.

(56) References Cited

U.S. PATENT DOCUMENTS

2015/0204763 A1* 7/2015 Stelzle ..... G01N 1/30 435/6.11

FOREIGN PATENT DOCUMENTS

CN 107583694 A 1/2018

* cited by examiner

*Primary Examiner* — Jennifer Wecker
*Assistant Examiner* — Jonathan Bortoli
(74) *Attorney, Agent, or Firm* — Anova Law Group, PLLC

(57) ABSTRACT

A microfluidic chip, a method for driving a microfluidic chip and an analysis apparatus are provided. An exemplary microfluidic chip includes a substrate; a number of M driving electrodes disposed on a side of the substrate and arranged along a first direction; and a number of N signal terminals electrically connected to the number of M driving electrodes. Any three adjacent driving electrodes are connected to different signal terminals, respectively; a number of A of the number of M driving electrodes are connected to a same signal terminal; and M, N and A are positive integers, and M≥4, N≥3, M>N, and A≥2.

20 Claims, 9 Drawing Sheets

MICROFLUIDIC CHIP AND DRIVING METHOD THEREOF AND ANALYSIS APPARATUS

CROSS-REFERENCES TO RELATED APPLICATIONS

This application claims priority of Chinese Patent Application No. 201910244503.6, filed on Mar. 28, 2019, the entire contents of which are hereby incorporated by reference.

FIELD OF THE DISCLOSURE

The present disclosure generally relates to the field of microfluidics and, more particularly, relates to a microfluidic chip, a method for driving a microfluidic chip and an analysis apparatus.

BACKGROUND

Microfluidics is the science and technology involved in systems that use microanalytical devices to process or manipulate micro-fluids; and it is an emerging interdisciplinary science involving chemistry, fluid physics, microelectronics, new material, and biomedical engineering. The microfluidic chip plays an extremely important role in the development of the microfluidic technology. Due to its miniaturization, integration and terminalability, the microfluidic chip integrates the functions of sampling, reaction, separation and detection of samples. The microfluidics has great development potential and broad application prospects in the fields of chemical synthesis, biomedicine, and environmental monitoring, etc.

In a microfluidic chip, when the number of driving electrodes is large, a large number of signal terminals need to be disposed correspondingly to provide electrical signals to the driving electrodes, and the driving electrical signals are complicated, and the production cost of the microfluidic chip may be substantially high.

Therefore, there is a need to reduce the number of signal terminals and the production cost of the microfluidic chip. The disclosed microfluidic chip, driving method and analysis apparatus are directed to solve one or more problems set forth above and other problems in the art.

BRIEF SUMMARY OF THE DISCLOSURE

One aspect of the present disclosure provides a microfluidic chip. The microfluidic chip may include a substrate; a number of M driving electrodes disposed on a side of the substrate and arranged along a first direction; and a number of N signal terminals electrically connected to the number of M driving electrodes. Any three adjacent driving electrodes may be connected to different signal terminals, respectively; a number of A of the number of M driving electrodes may be connected to a same signal terminal; and M, N and A may be positive integers, and $M \geq 4$, $N \geq 3$, $M > N$, and $A \geq 2$.

Another aspect of the present disclosure provides a method for driving a microfluidic chip. The method may include providing a microfluidic chip. The microfluidic chip may include a substrate; a number of M driving electrodes disposed on a side of the substrate and arranged along a first direction; and a number of N signal terminals electrically connected to the number of M driving electrodes. Any three adjacent driving electrodes may be connected to different signal terminals, respectively; a number of A of the number of M driving electrodes may be connected to a same signal terminal; and M, N and A may be positive integers, and $M \geq 4$, $N \geq 3$, $M > N$, and $A \geq 2$. The method may also include using the signal terminals to provide electrical signals to the driving electrodes to drive a liquid droplet to move along the first direction. A same electrical signal may be provided to the number of A driving electrodes through one signal terminal.

Another aspect of the present disclosure provides an analysis apparatus. The analysis apparatus may include a microfluidic chip. The microfluidic chip may include a substrate; a number of M driving electrodes disposed on a side of the substrate and arranged along a first direction; and a number of N signal terminals electrically connected to the number of M driving electrodes. Any three adjacent driving electrodes may be connected to different signal terminals, respectively; a number of A of the number of M driving electrodes may be connected to a same signal terminal; and M, N and A may be positive integers, and $M \geq 4$, $N \geq 3$, $M > N$, and $A \geq 2$.

Other aspects of the present disclosure can be understood by those skilled in the art in light of the description, the claims, and the drawings of the present disclosure.

BRIEF DESCRIPTION OF THE DRAWINGS

The following drawings are incorporated in and constitute a part of the specification, illustrating embodiments of the present disclosure, and together with the detailed descriptions serve to explain the mechanism of the present disclosure.

DETAILED DESCRIPTION

Figure 1:
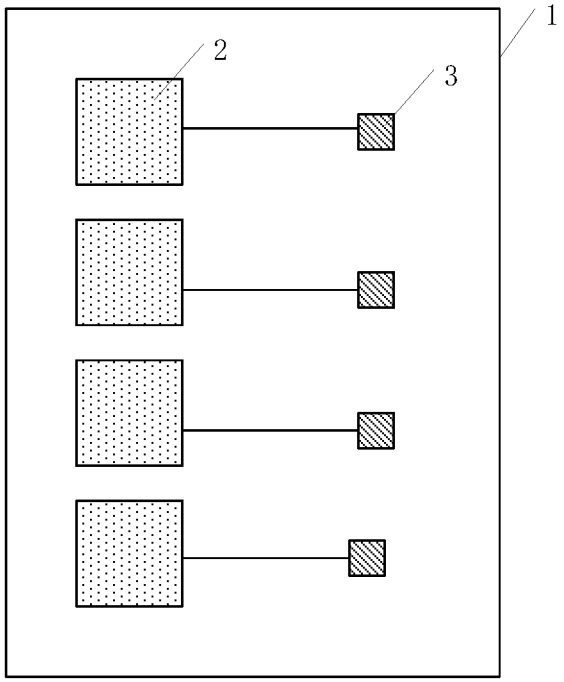
FIG. 1 illustrates a microfluidic chip.

Reference will now be made in detail to exemplary embodiments of the disclosure, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all the embodiments of the present disclosure. Based on the disclosed embodiments, persons of ordinary skill in the art may derive other embodiments consistent with the present disclosure, all of which are within the scope of the present disclosure. Further, in the present disclosure, the disclosed embodiments and the features of the disclosed embodiments may be combined when there are no conflicts.

Certain techniques, methods, and apparatus that are understandable to the persons of ordinary skill in the art may not be described in detail. However, under appropriate conditions, such techniques, methods and apparatus are also included as the parts of the description.

In the disclosed embodiments, specific values may be explained for illustrative purposes and might not be used as limitations. Thus, embodiments may have different specific values.

Further, the similar symbols and letters in the drawings may denote similar elements. Thus, once one element is defined in one drawing, it may not need to be defined in the following drawings.

FIG. 1 illustrates a microfluidic chip. As shown in FIG. 1, the microfluidic chip includes a substrate 1, electrodes 2 disposed on the substrate 1, and signal terminals 3. The signal terminal 3 and the electrodes 2 are electrically connected one by one, and the signal terminal 3 is used to provide an electrical signal to the electrode 2 to drive a liquid droplet to move in the microfluidic chip. The electrical driving signals of the microfluid chip are complicated, and the production cost of the microfluidic chip may be substantially high.

The present disclosure provides a microfluidic chip, a method for driving microfluid chip and an analysis apparatus.

Figure 2:
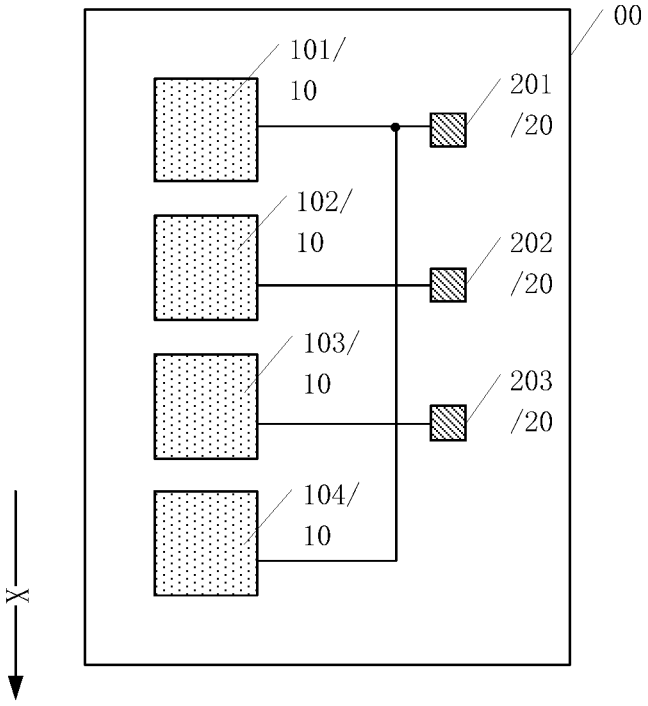
FIG. 2 illustrates an exemplary microfluidic chip consistent with various disclosed embodiments.

FIG. 2 illustrates an exemplary microfluidic chip consistent with various disclosed embodiments. As shown in FIG. 2, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected. Any three adjacent driving electrodes 10 may be electrically connected to different signal terminals 20. Further, a number of A driving electrodes 10 may be electrically connected to a same signal terminal 20. M, N, and A may be all positive integers, and $M \geqslant 4$, $N \geqslant 3$, $M>N$, and $A \geqslant 2$.

In one embodiment, for illustrative purposes, that M=4, N=3, and A=2 is taken as an example for description.

The substrate 00 may be used to carry the structures of the driving electrodes 10, and the signal terminals 20, etc. The substrate 00 may be a rigid substrate, for example, made of a glass material. The substrate 00 may also be made of other appropriate material; and the material of the substrate 00 is not limited by the present disclosure.

The number of M driving electrodes 10 may be disposed on the substrate 00. Other types of electrodes may also be disposed on the substrate; and the type of the electrodes is not limited by the present disclosure.

In one embodiment, the driving electrode 10 may be rectangular-shaped or square-shaped. The shape of the driving electrodes 10 may be various; and is not specifically limited in the present disclosure.

The number of M driving electrodes 10 may be arranged along the first direction X. When the microfluidic chip is in operation to drive a liquid droplet to move, the first direction X may be the moving direction of the liquid droplet.

The microfluidic chip may also include the number of N signal terminals 20. The signal terminals 20 may be used to transmit driving signals to the driving electrodes 10. In one embodiment, the signal terminals 20 may be electrically connected to a signal processor inside or outside the microfluidic chip. The connection configuration of the signal terminals 20 is not limited by the present disclosure.

In one embodiment, the number of M driving electrodes 10 and the number of N signal terminals 20 may have a specific electrical connection scheme; and the number of the signal terminals 20 may be reduced. In particular, any three adjacent driving electrodes 10 may be electrically connected to different signal terminals 20, respectively; and at least two driving electrodes 10 may be electrically connected to a same signal terminal 20.

To clearly explain the technical solution of the present embodiment, the driving electrodes 10 and the signal terminals 20 may be numbered. In particular, the four driving electrodes 10 illustrated in FIG. 2 may be numbered as the first driving electrode 101, the second driving electrode 102, the third driving electrode 103, and the fourth driving electrode 104, respectively; and the three signal terminals 20 may be numbered as the first signal terminal 201, the second signal terminal 202, and the third signal terminal 203, respectively. Further, any three adjacent driving electrodes 10 may be electrically connected to different signal terminals 20, respectively, such that any three adjacent driving electrodes 10 may be different to avoid affecting the normal motion of the liquid droplet. In particular, when two or three of the any three adjacent driving electrodes 10 are electrically connected to a same signal terminal 20, the liquid droplet may be unable to move normally. For example, when the first driving electrode 101 and the third driving electrode 103 are electrically connected to a same signal terminal, such two driving electrodes may receive a same electrical signal. When the liquid droplet moves from the first driving electrode 101 to the second driving electrode 102, if the liquid droplet is intended to continue to move to the third driving electrode 103, because the electrical signals on the first driving electrode 101 and the third driving electrode 103 are the same, the liquid droplet may be simultaneously subjected to the electric field between the first driving electrode 101 and the second driving electrode 102 and the electric field between the second driving electrode 102 and the third driving electrode 103. Under such a condition, the liquid droplet may stay on the second driving electrode 102; and the liquid droplet may not move normally. Similarly, it can be referred that when any three adjacent driving electrodes 10 are electrically connected to a same signal terminal 20, the liquid droplet may not be moved normally. Therefore, to ensure that the liquid droplet may normally move, in one embodiment, any three adjacent driving electrodes 10 may be electrically connected to different signal terminals 20, respectively.

In one embodiment, both the first driving electrode 101 and the fourth driving electrode 104 are electrically connected to the first signal terminal 201. An electrical signal may be supplied to the first driving electrode 101 and the fourth driving electrode 104 through the first signal terminal 201. Thus, the number of the signal terminals 20 may be reduced.

The number M, N, and A respectively may have multiple appropriate values, and it may only require satisfying that M, N, and A are positive integers, and $M \geqslant 4$, $N \geqslant 3$, $M>N$, and A≥2. The specific value of M, N and A may be selected according to the actual requirements of the microfluidic chip.

The microfluidic chip may have at least the following beneficial effects. The number of M driving electrodes 10 and the number of N signal terminals 20 may be disposed in the microfluidic chip; and the signal terminals 20 and the driving electrodes 10 may be electrically connected for providing electrical driving signals to the driving electrodes 10. The number of M driving electrodes 10 and the number of N signal terminals 20 may have a specific electrical connection configuration; and the number of the signal terminals 20 may be reduced. In particular, any three adjacent driving electrodes 10 may be electrically connected to different signal terminals 20, respectively, to ensure a normal movement of the liquid droplet. Further, at least two of the driving electrodes 10 may be electrically connected to a same signal terminal 20, and M>N. The electrical driving signals may be supplied to at least two driving electrodes 10 through one signal terminal 20. Thus, the number of signal terminals 20 may be reduced; the complexity of the driving signals 20 may be reduced; and the production cost of the microfluidic chip may be reduced.

Figure 3:
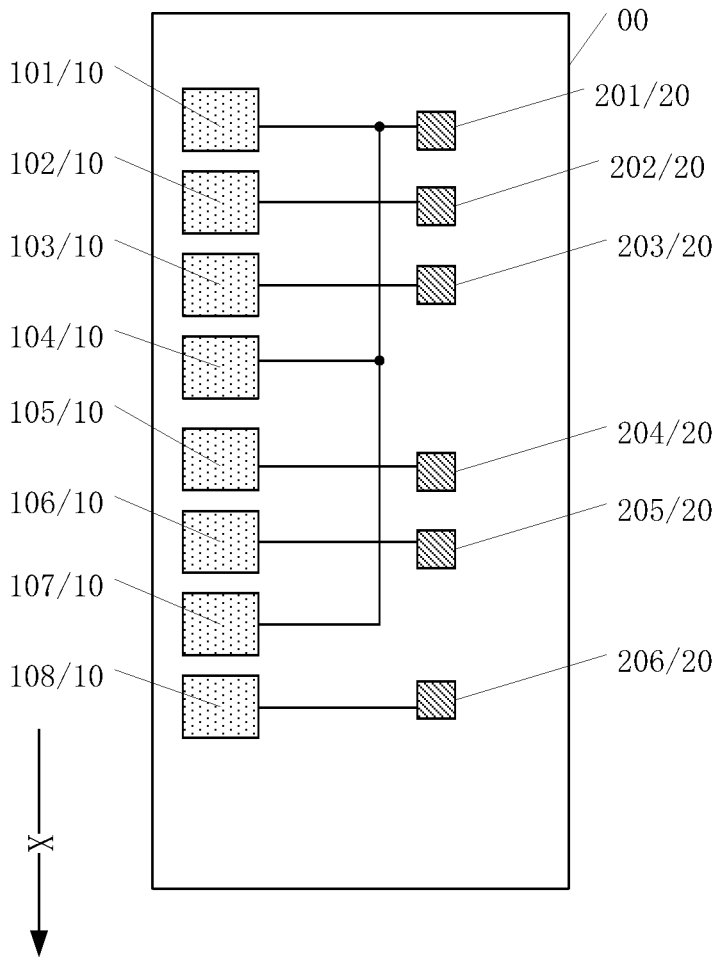
FIG. 3 illustrates another exemplary microfluidic chip consistent with various disclosed embodiments.

FIG. 3 illustrates another exemplary microfluidic chip consistent with various disclosed embodiments. As shown in FIG. 3, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected.

In one embodiment, at least three driving electrodes 10 may be electrically connected to a same signal terminal 20. The at least three driving electrodes 10 may be disposed between two driving electrodes 10 at an interval of a number of B driving electrodes. B may be a positive integer; and B ≥2.

In one embodiment, for illustrative purposes, a combination of M=8, N=6 and A=3 is taken as an example for the description.

To clearly explain the technical solution of the present embodiment, the driving electrodes and the signal terminals may be numbered. In particular, the eight driving electrodes 10 shown in FIG. 3 may be numbered as the first driving electrode 101 to the eighth driving electrode 108, respectively; and the six signal terminals 20 may be respectively numbered as the first signal terminal 201 to the sixth signal terminal 206.

The first driving electrode 101, the fourth driving electrode 104, and the seventh driving electrode 107 may be electrically connected to the first signal terminal 201. The second driving electrode 102, the third driving electrode 103, the fifth driving electrode 105, the sixth driving electrode 106, and the eighth driving electrode 108 may be electrically connected in a one-to-one correspondence with the other signal terminals 20, respectively.

For the first driving electrode 101, the fourth driving electrode 104, and the seventh driving electrode 107, the number of the driving electrodes 10 disposed at an interval of two driving electrodes 10 may be the same. In one embodiment, that two driving electrodes 10 are spaced apart between the first driving electrode 101 and the fourth driving electrode 104 and two driving electrodes 10 are spaced apart between the fourth driving electrode 104 and the seventh driving electrode 107 are used as an example for the description. As used herein, "between two" specifically refers that the two driving electrodes 10 electrically connected to the same signal terminal are between the two driving electrodes 10 arranged along the first direction X; and the driving electrodes 10 between such two driving electrodes 10 may be electrically connected to other signal terminals.

In one embodiment, for illustrative purposes, that only the driving electrodes 10 other than the first driving electrode 101, the fourth driving electrode 104, and the seventh driving electrode 107 are electrically connected in a one-to-one correspondence with the signal terminals 20, respectively, is used as an example for the description. In some embodiments, besides the driving electrodes 10 other than the first driving electrode 101, the fourth driving electrode 104, and the seventh driving electrode 107, at least two other driving electrodes 10 may be electrically connected to a same signal terminal 20.

In the disclosed microfluidic chip, for the at least three driving electrodes 10 electrically connected to the same signal terminal 20, the connection configuration may be regular, and the number of the driving electrodes 10 disposed at the interval of two driving electrodes 10 may be the same. Correspondingly, when the first signal terminal 201 provides a driving signal to the first driving electrode 101, the fourth driving electrode 104, and the seventh driving electrode 107, the electrical driving signal of the signal terminal 201 may be regular. Thus, the complexity of the electrical driving signal on the first signal terminal 201 may be simplified; and the production cost of the microfluidic chip may be reduced.

Figure 4:
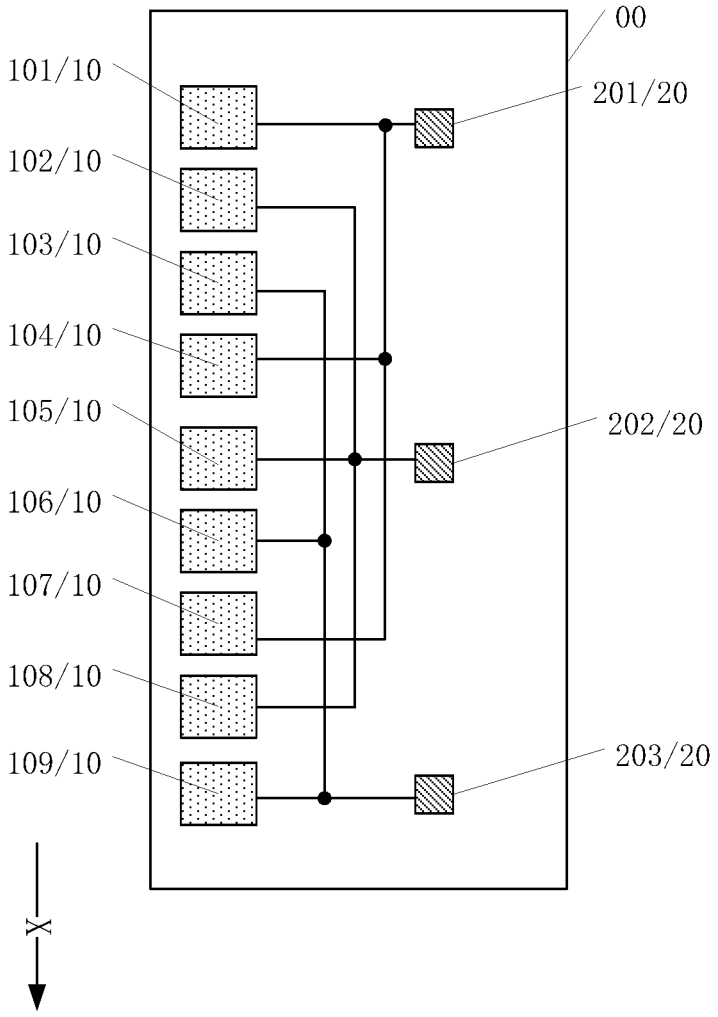
FIG. 4 illustrates another exemplary microfluidic chip consistent with various disclosed embodiments.

FIG. 4 illustrates another exemplary microfluidic chip consistent with various disclosed embodiments. As shown in FIG. 4, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected.

In one embodiment, the number of M may be an integer multiple of the number of N; and the number of driving electrodes 10 electrically connected to each of the signal terminals 20 may the same.

In one embodiment, for illustrative purposes, a combination of M=9, N=3 and A=3 is as an example for the description.

To clearly explain the technical solution of the present embodiment, the driving electrodes 10 and the signal terminals 20 may be numbered. In particular, and the nine driving electrodes 10 shown in FIG. 3 may be numbered as the first driving electrode 101 to the ninth driving electrode 109, respectively, and the three signal terminals 20 may be respectively numbered as the first signal terminal 201 to the third signal terminal 203.

As shown in FIG. 4, the first driving electrode 101, the fourth driving electrode 104, and the seventh driving electrode 107 may be electrically connected to the first signal terminal 201. The second driving electrode 102, the fifth driving electrode 105, and the eighth driving electrode 108 may be electrically connected to the second signal terminal 202. The third driving electrode 103, the sixth driving electrode 106, and the ninth driving electrode 109 may be electrically connected to the third signal terminal 203.

In such a microfluidic chip, each signal terminal 20 may be electrically connected to three of the driving electrodes 10, and the number of M may be an integer multiple of the number of N. Thus, the number of the signal terminals 20 may be significantly reduced; and the microfluidic chip may be greatly simplified. Accordingly, the production cost of the microfluidic chip may be reduced. Moreover, the number of the driving electrodes 10 electrically connected to each of the signal terminals 20 may be the same, which may be advantageous for equalizing the load of each signal terminal 20. Thus, the uniformity of the driving signals applied on the driving electrodes 10 may be improved, and the performance of the microfluidic chip may be enhanced.

Further, as shown in FIG. 4, in one embodiment, the number of M driving electrodes 10 may be sequentially the first driving electrode 10 to the M-th driving electrode 10 along the first direction X; and the number of N signal terminals 20 may be respectively the first signal terminal 20 to the N-th signal terminal 20. The electrical connection relationship between the number of M driving electrodes 10 and the number of N signal terminals 20 may be that the n-th signal terminal 20 and the number of (a*N+n) driving electrodes 10 may be electrically connected. "n" may be a positive integer; and $n \leqslant N$. "a" may be a natural number; and $a*N+n \leqslant M$.

In one embodiment, for illustrative purposes, M=9, N=3, and A=3.

The nine driving electrodes 10 may be sequentially the first driving electrode 101 to the ninth driving electrode 109 along the first direction X, and the three signal terminals 20 may be the first signal terminal 201 to the third signal terminal 203, respectively. The electrical connection relationship between the nine driving electrodes 10 and the three signal terminals 20 may be as following.

For the first signal terminal 201, "a" is a natural number; and $a*3+1 \leqslant 9$. "a" may be 0, 1, or 2. Thus, the driving electrodes 10 electrically connected to the first signal terminal 201 may be respectively the first driving electrode 101, the fourth driving electrode 104, and the seventh driving electrode 107.

Similarly, for the second signal terminal 201, "a" may be a natural number, and $a*3+2 \leqslant 9$. "a" may be 0, 1, or 2. Thus, the driving electrodes 10 electrically connected to the second signal terminal 202 may be respectively the second driving electrode 102, the fifth driving electrode 105 and the eighth driving electrode 108.

Similarly, for the third signal terminal 201, "a" may be a natural number; and $a*3+3 \leqslant 9$. "a" may be 0, 1, or 2. Thus, the driving electrodes 10 electrically connected to the third signal terminal 203 may be respectively the third driving electrode 103, the sixth driving electrode 106, and the ninth driving electrode 109.

In one embodiment, for the first driving electrode 10 to the M-th driving electrode 10 sequentially arranged along the first direction X, their electrical connections with the N signal terminals 20 may follow the specific rule as described above. Correspondingly, the electrical signal transmitted by each signal terminal 20 to the driving electrode 10 may also be regular. Thus, the complexity of the electrical driving signals applied on the signal terminals 10 may be further simplified; and the production cost of the microfluidic chip may be further reduced.

In some embodiments, the microfluidic chip may have a greater number of driving electrodes; and each driving electrode may be connected to three signal terminals by following the above described rules. In particular, three signals may be used to control the movement of the liquid droplet. Thus, the driving circuit may be simplified; the number of the signal terminals may be greatly reduced; and the production cost may be effectively reduced.

In the previous embodiments, for illustrative purposes, the driving electrodes 10 with a rectangular shape are used as an example. In some embodiments, the driving electrodes 10 may also be square-shaped.

Figure 5:
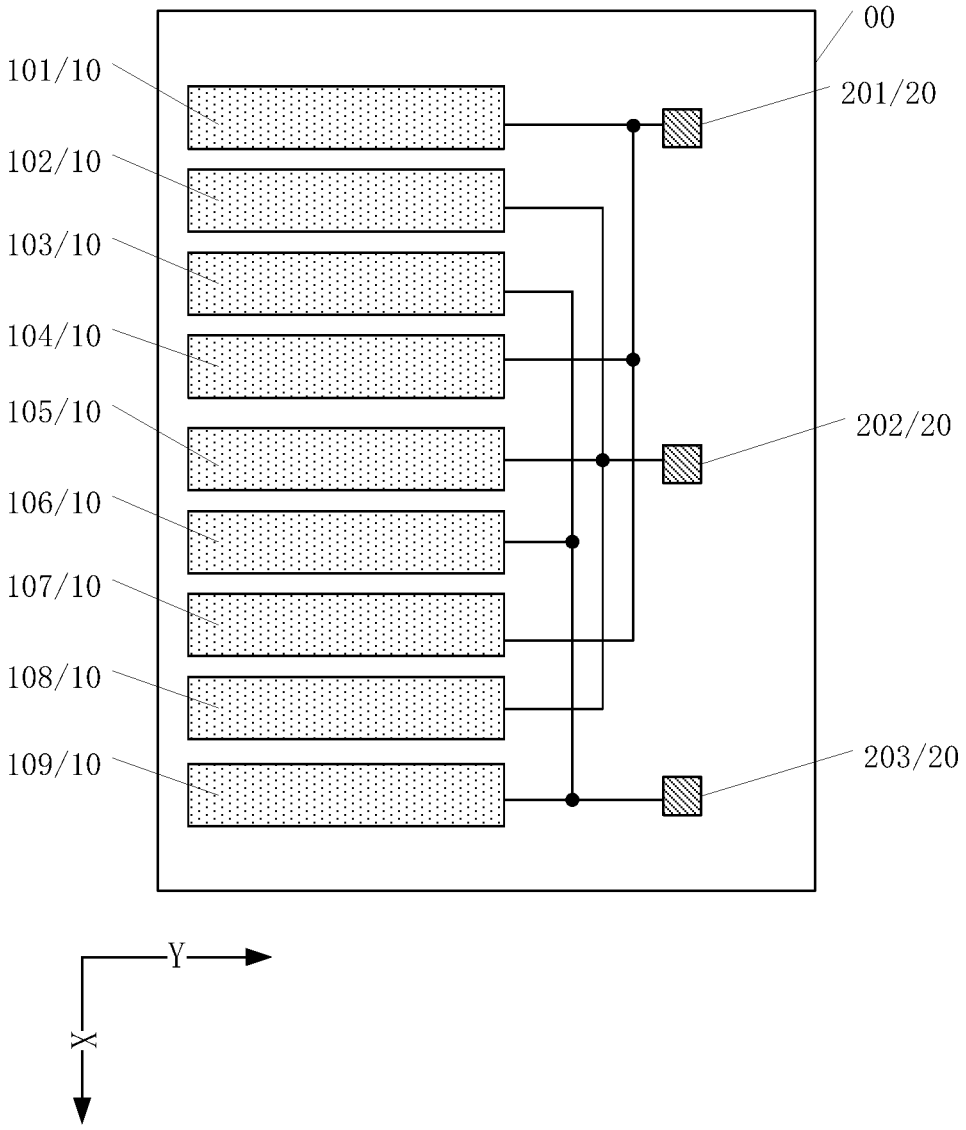
FIG. 5 illustrates another exemplary microfluidic chip consistent with various disclosed embodiments.

FIG. 5 illustrates another exemplary microfluidic chip consistent with various disclosed embodiments. As shown in FIG. 5, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected. M and N may be integers; and $M \geq N$.

To clearly explain the technical solution of the embodiment, the driving electrodes 10 and the signal terminals 20 may be numbered. In particular, and the ninth driving electrodes 10 shown in FIG. 5 may be numbered as the first driving electrode 101 to the ninth driving electrode 109, respectively; and the three signal terminals 20 may be respectively numbered as the first signal terminal 201 to the third signal terminal 203.

Further, as shown in FIG. 5, the driving electrode 10 may have an elongated shape extending along a second direction Y. The second direction Y may be perpendicular to the first direction X.

In such a microfluidic chip, the driving electrodes 10 may have the elongated shape. When the microfluidic chip is in operation, the microfluidic chip may be able to move a plurality of liquid droplets simultaneously. Thus, the working efficiency of the microfluidic chip may be improved.

Figure 6:
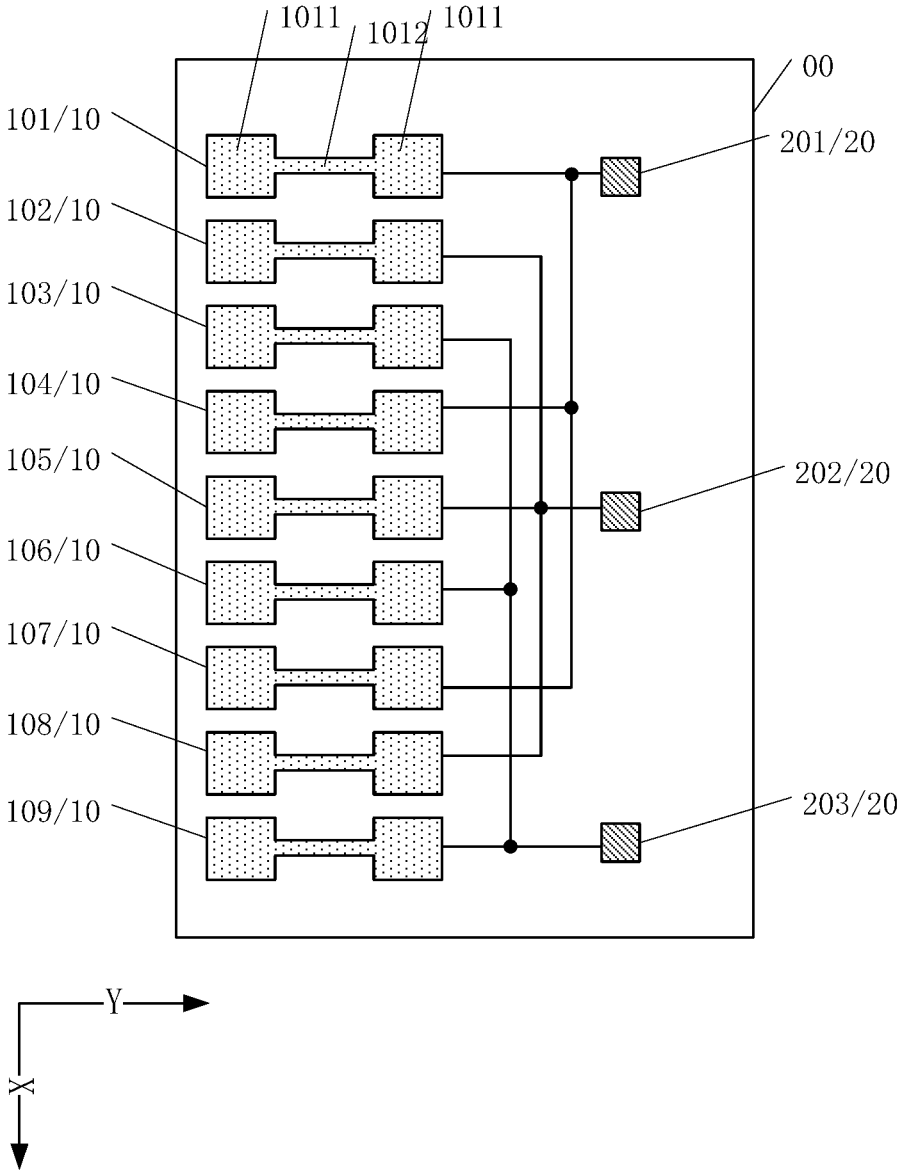
FIG. 6 illustrates another exemplary microfluidic chip consistent with various disclosed embodiments.

FIG. 6 illustrates another exemplary microfluidic chip consistent with various disclosed embodiments. As shown in FIG. 6, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected. M and N may be integers; and $M \geq N$.

To clearly explain the technical solution of the embodiment, the driving electrodes 10 and the signal terminals 20 may be numbered. In particular, and the nine driving electrodes 10 shown in FIG. 6 may be numbered as the first driving electrode 101 to the ninth driving electrode 109, respectively, and the three signal terminals 20 may be respectively numbered as the first signal terminal 201 to the third signal terminal 203.

Further, as shown in FIG. 6, each driving electrode 10 may include at least to sub-electrodes 1011. The two sub-electrodes 1011 may be electrically connected through a connection part 1012.

In the microfluidic chip shown in FIG. 6, for illustrative purposes, that one driving electrode 10 includes two sub-electrodes 1011 is used as an example. In some embodiments, one driving electrode 10 may include three or more sub-electrodes 1011. The two sub-electrodes 1011 in one drive electrode 10 may be electrically connected by the connection part 1012. In particular, for the same driving electrode 10, the electrical driving signals received by the corresponding sub-electrodes 101 may be the same.

When such a microfluidic chip is in operation, at least two liquid droplets may be moved at a same time. The number of liquid droplets moved at the same time may be the same as the number of the sub-electrodes 1011 in one driving electrode 10. For example, when the driving electrode 10 includes a number of N sub-electrodes 1011, a number of N liquid droplets may be moved simultaneously by the driving electrode 10. N may a positive integer; and N⩾2.

The two sub-electrodes 1011 in the driving electrode 10 may be electrically connected through the connection part 1012. Generally, the width of the connection part 1012 along the first direction X may be smaller than the width of the sub-electrode 1011 such that the liquid droplets may be prevented from deviating from the preset moving trajectory. Thus, the accuracy of the liquid droplet movement may be improved.

Figure 7:
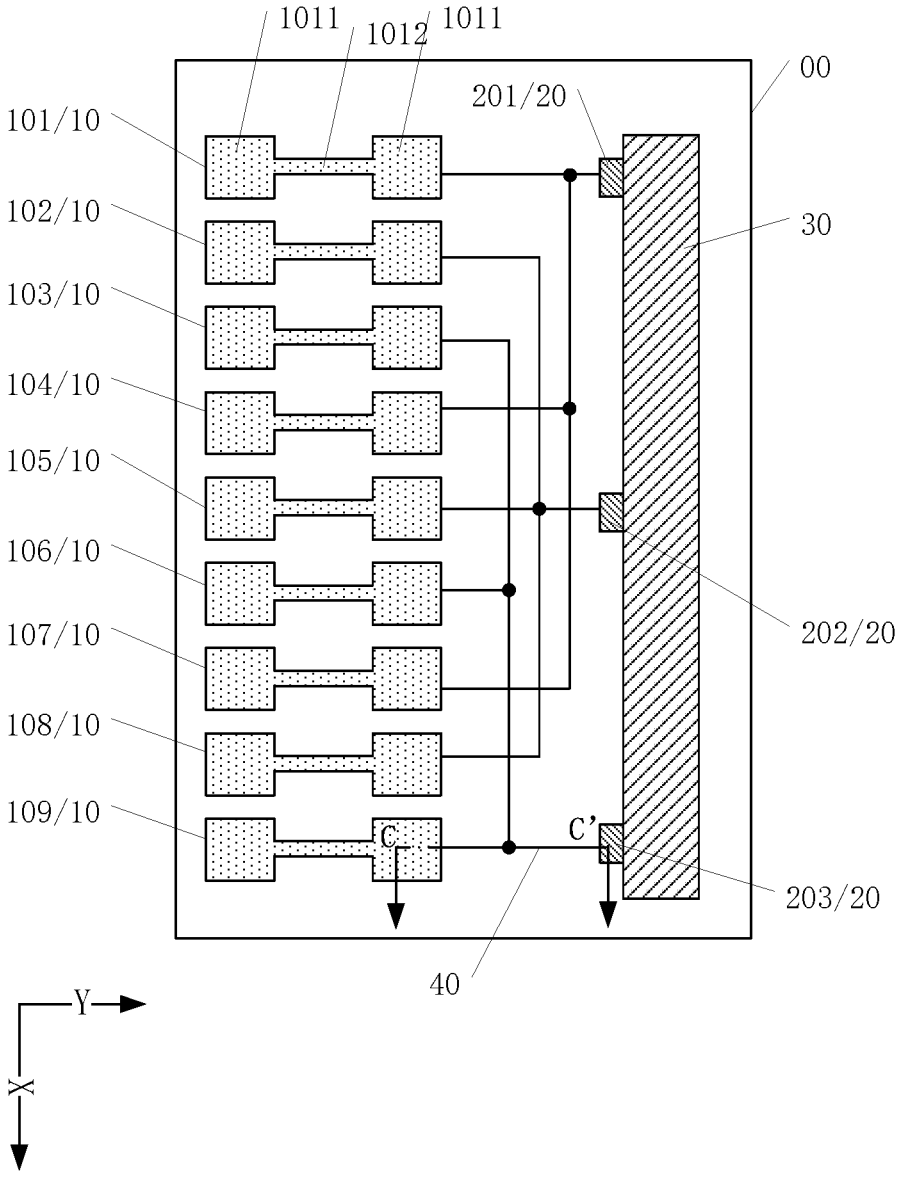
FIG. 7 illustrates another exemplary microfluidic chip consistent with various disclosed embodiments.

FIG. 7 illustrates another exemplary microfluidic chip consistent with various disclosed embodiments. As shown in FIG. 7, the microfluidic chip may include a substrate 00; and a number of M driving electrodes 10 disposed on a side of the substrate 00 and arranged along a first direction X. The microfluidic chip may also include a number of N signal terminals 20. The signal terminals 20 and the driving electrodes 10 may be electrically connected. M and N may be integers; and M≥N.

To clearly explain the technical solution of the embodiment, the driving electrodes 10 and the signal terminals 20 may be numbered. In particular, and the nine driving electrodes 10 shown in FIG. 7 may be numbered as the first driving electrode 101 to the ninth driving electrode 109, respectively, and the three signal terminals 20 may be respectively numbered as the first signal terminal 201 to the third signal terminal 203.

Further, as shown in FIG. 7, each driving electrode 10 may include at least two sub-electrodes 1011. The two sub-electrodes 1011 may be electrically connected through a connection part 1012.

Further, as shown in FIG. 7, the microfluidic chip may also include a signal processing chip 30. The signal processing chip 30 may be electrically connected to the N signal terminals 20.

In one embodiment, the signal processing chip 30 may be used to transmit electrical driving signals to the signal terminals 20. Because the number of the signal terminals 20 of the disclosed microfluidic chip may be reduced, the number of pins of the signal processing chip 30 may also be reduced. Accordingly, the production cost of the signal processing chip 30 may be reduced; and the production cost of the microfluidic chip may be reduced accordingly.

Further, as shown in FIG. 7, the microfluidic chip may also include a number of N connection lines 40. The connection lines 40 and the signal terminals 20 may electrically connected in a one-on-one correspondence. The driving electrodes 10 electrically connected to the same signal terminal 20 may be connected to the corresponding signal terminal 20 through a connection line 40.

In such microfluidic chip, the driving electrodes 10 electrically connected to the same signal terminal 20 may be first electrically connected to the same connection line 40, and then electrically connected to the signal terminal 20 through the connection line 40. Thus, the complicated structure caused by directly connecting all the driving electrodes 10 to the signal terminals 20 may be avoided. Accordingly, the structural design of the microfluidic chip may be simplified. The number of N connecting lines 40 may be disposed on a same metal layer or in different metal layers; and the specific setting manner may be designed according to the actual situation of the microfluidic chip.

Figure 8:
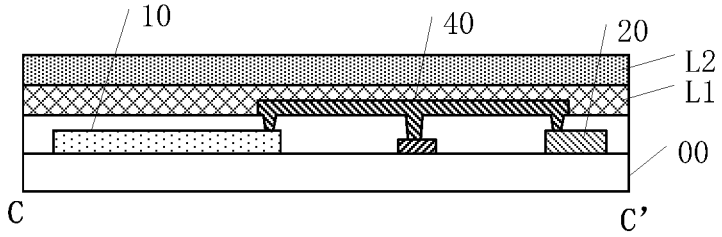
FIG. 8 illustrates a CC'-sectional view of the structure illustrated in FIG. 7.

FIG. 8 illustrates a CC'-sectional view of the microfluidic chip shown in FIG. 7. As shown in FIG. 7 and FIG. 8, in one embodiment, the connecting lines 40 and the driving electrodes 10 may be disposed in different conductive layers. Further, the microfluidic chip may also include a dielectric layer L1 and a hydrophobic layer L2 sequentially disposed on a side of the driving electrode 10 facing away from the substrate 00. The dielectric layer L1 may have good insulating properties, and the hydrophobic layer L2 may ensure a smooth and stable liquid droplet movement.

In some embodiments, the microfluidic chip may also include other appropriate film layer structures.

In the microfluidic chip, the connection lines 40 may be disposed on a side of the driving electrodes 10 close to the substrate 00 or may be disposed on a side of the driving electrodes 10 facing away from the substrate 00. As shown in FIG. 8, for illustrative purposes, that the connection lines 40 are disposed on the side of the drive electrode 10 facing away from the substrate 00 is used as an example for the description. Disposing the connecting lines 40 and the driving electrodes 10 in different layers may facilitate the flexible disposition of the signal lines in the microfluidic chip to avoid the cross-short of the signal lines.

Figure 9:
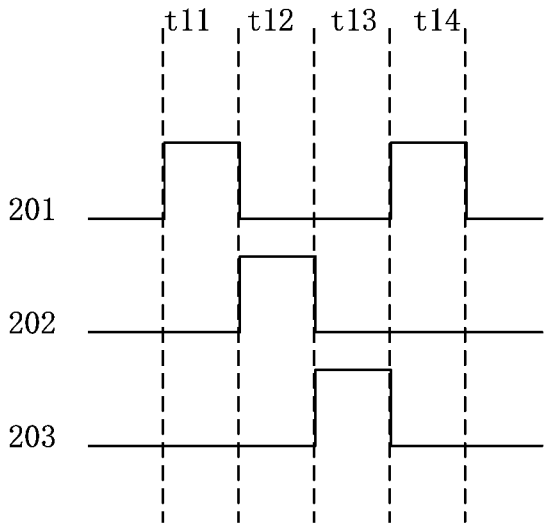
FIG. 9 illustrates an exemplary time sequence diagram of the microfluidic chip illustrated in FIG. 2 consistent with various disclosed embodiments.
Figure 13:
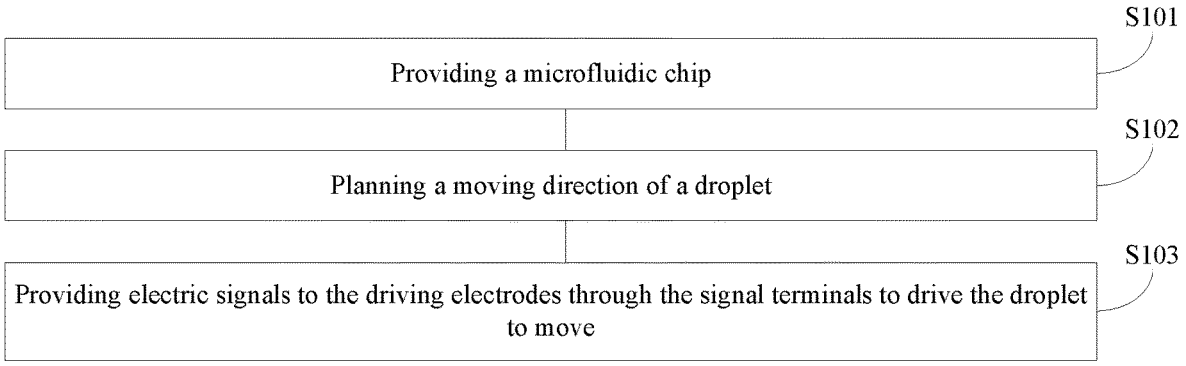
FIG. 13 illustrates an exemplary method for driving a microfluidic chip consistent with various disclosed embodiments.

The present disclosure also provides a driving method of a microfluidic chip. FIG. 13 illustrates an exemplary driving method of a microfluidic chip consistent with various disclosed embodiments. FIG. 9 illustrates an exemplary time sequence diagram for driving the microfluidic chip shown in FIG. 2.

The driving method may include providing a microfluidic chip (S101). In one embodiment, the microfluidic chip is the microfluidic chip illustrated in FIG. 2; and may include a substrate 00; a number of M driving electrodes 10 disposed on a side of the substrate 00 and arranged along a first direction X; and a number of N signal terminals 20. The signal terminals 20 and the driving electrodes 10 may be electrically connected; and any three adjacent driving electrodes 10 may be electrically connected to different signal terminals 20. A number of A driving electrodes 10 may be electrically connected to a same signal terminal 20. As used herein, A, M, and N may be positive integers, and M⩾4, N⩾3, M>N, and A⩾2.

As shown in FIG. 13, the driving method may also include planning the moving direction of a liquid droplet (S102), i.e., determining the moving direction of the liquid droplet. In one embodiment, the moving direction of the liquid droplet may be the first direction X.

Further, the method may include providing electrical signals to the driving electrodes through the signal terminals to drive the liquid droplet to move along the first direction (S103). In particular, the electrical signals may be provided to the driving electrodes 10 through the signal terminals 20. One electrical signal may be provided to the number of A driving electrodes 10 through one signal terminal 20.

In the microfluidic chip driven by the disclosed driving method, the number of M driving electrodes 10 may be arranged along the first direction X. Correspondingly, the first direction X may be the moving direction of the liquid droplet. In particular, the electrical signals may be sequentially applied on the driving electrodes 10 through the signal terminals 20 such that the liquid droplet may be driven to move along the first direction X.

Because the number of A driving electrodes 10 may be electrically connected to a same signal terminal 20, in one embodiment, both the first driving electrode 101 and the fourth driving electrode 104 may be electrically connected to the first signal terminal 201, and the electrical signals supplied to the first driving electrode 101 and the fourth driving electrode 104 through the signal terminal 201 may be the same.

FIG. 9 illustrates an exemplary time sequence diagram of the electrical signals applied to the respective signal terminals 20. At a first time period t11, a driving signal, i.e., an electric signal, may be supplied to the first driving electrode 101 and the fourth driving electrode 104 through the first signal terminal 201, and the liquid droplet may be moved to the first driving electrode 101. At a second time period t12, a driving signal may be supplied to the second driving electrode 102 through the second signal terminal 202 to move the liquid droplet from the first driving electrode 101 to the second driving electrode 102. At a third time period t13, a driving signal may be supplied to the third driving electrode 103 through the third signal terminal 203, and the liquid droplet may be moved from the second driving electrode 102 to the third driving electrode 103. At a fourth time period t14, a driving signal may be supplied to the first driving electrode 101 and the fourth driving electrode 104 through the first signal terminal 201, and the liquid droplet may be moved from the third driving electrode 103 to the fourth driving electrode 104.

In one embodiment, any three adjacent driving electrodes 10 may be electrically connected to different signal terminals 20, respectively, such that the any three adjacent driving electrodes 10 may be different to avoid affecting the normal movement of the liquid droplet. In particular, in the first time period t11, because the liquid droplet may be far from the fourth driving electrode 104, the driving signal of the fourth driving electrode 104 may have little influence on the movement of the liquid droplet. Similarly, at the fourth time period t14, the electrical driving signal of the first driving electrode 101 may have little effect on the movement of the liquid droplet.

The disclosed method for driving the microfluidic chip may provide the same electrical signal to the number of A driving electrodes 10 through one signal terminal 20. Thus, the number of the signal terminals 20 may be reduced. Further, the number of the driving signals may be reduced; and the production cost of the microfluidic chip may be reduced.

Figure 10:
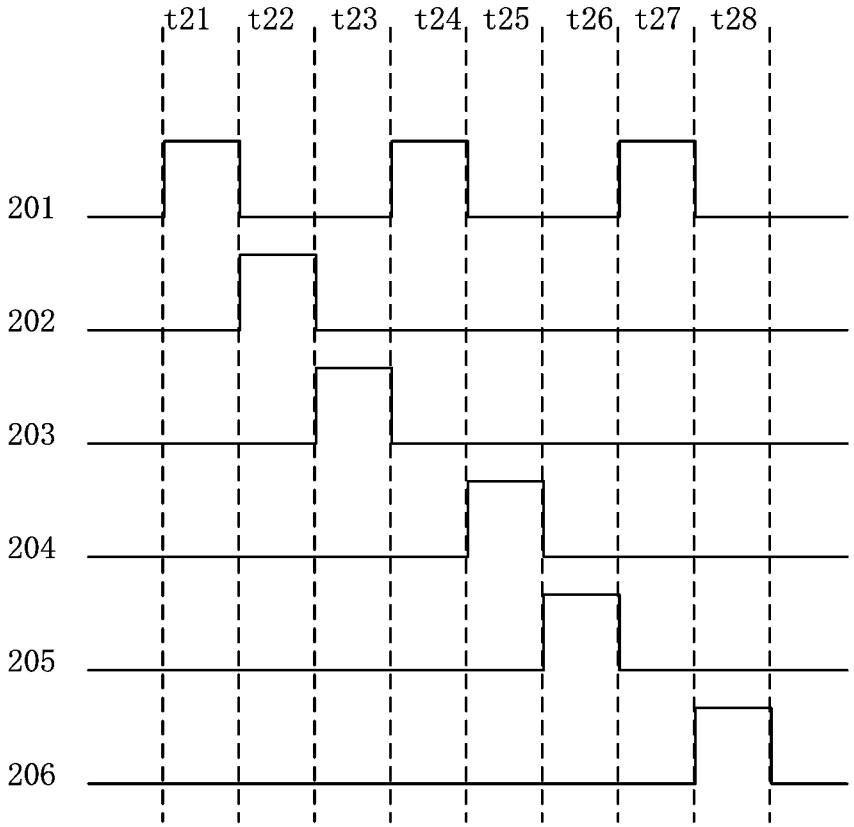
FIG. 10 illustrates an exemplary time sequence diagram of the microfluidic chip illustrated in FIG. 3 consistent with various disclosed embodiments.

FIG. 10 illustrates an exemplary time sequence diagram for the microfluidic chip shown in FIG. 3. As shown in FIG. 3, in the microfluidic chip, at least three driving electrodes 10 may be electrically connected to a same signal terminal 20. The at least three driving electrodes 10 may be disposed between two driving electrodes 10 with a certain interval of a number of B driving electrodes 10. B may be a positive integer; and $B \geq 2$.

A driving method for such a microfluidic chip may include providing an electrical signal to the at least three driving electrodes 10 through one of the signal terminals 20; and the electrical signal may be a pulse signal. The time interval between any two adjacent pulses may be the same.

FIG. 10 illustrates an exemplary time sequence diagram of the electrical signals applied on the respective signal terminals. The time sequence diagram shown in FIG. 10 may include eight time periods, which are the first time period t21 to the eighth time period t28, respectively. The first signal terminal 201 to the sixth signal terminal 206 may sequentially provide electrical signals that can cause a liquid droplet to move from the first driving electrode 101 to the eighth driving electrode 108.

The first driving electrode 101, the fourth driving electrode 104, and the seventh driving electrode 107 may be electrically connected to the first signal terminal 201, and the number of the driving electrodes 10 disposed at intervals between the first driving electrode 101, the forth driving electrode 104, and the seventh driving electrode 107 may be the same. Accordingly, when electrical signals are sequentially supplied to the driving electrodes 10 to drive the liquid droplet to move, the time between any two adjacent pulses on the first signal terminal 201 may be the same. The pulse signal on the first signal terminal 201 may be made regular. Thus, the complexity of the electrical signal applied on the first signal terminal 201 may be reduced; and the production cost of the microfluidic chip may be reduced.

Figure 11:
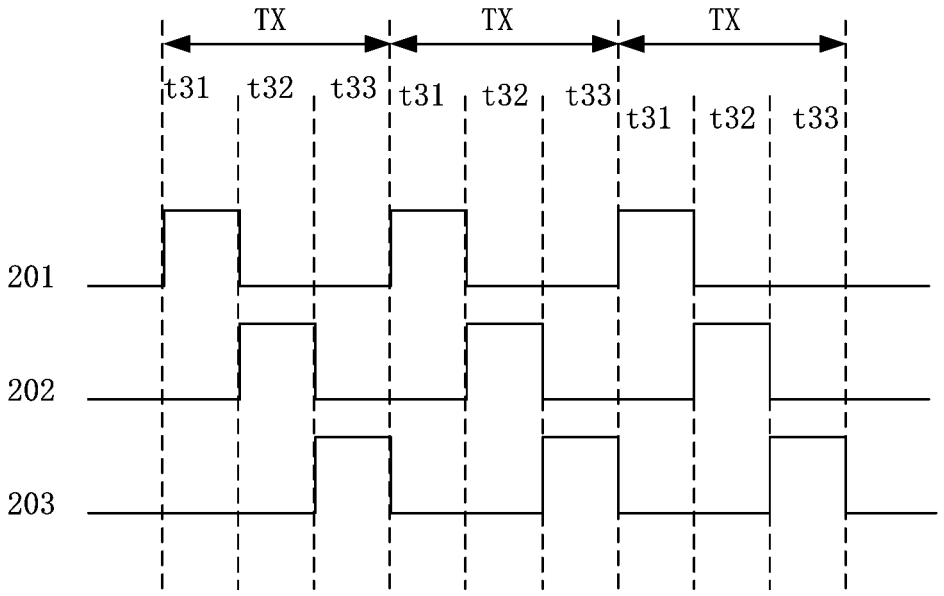
FIG. 11 illustrates an exemplary time sequence diagram of the microfluidic chip illustrated in FIG. 4 consistent with various disclosed embodiments.

FIG. 11 illustrates an exemplary time sequence diagram for driving the microfluidic chip shown in FIG. 4. In the microfluidic chip, the number of M may be an integer multiple of the number of N. The number of the driving electrodes 10 electrically connected to each signal terminal 20 may be the same.

The number of M driving electrodes 10 may be sequentially numbered as the first driving electrode 10 to the M-th driving electrode 10 along the first direction X. The number of N signal terminals 20 may be respectively numbered as the first signal terminal 20 to the N-th signal terminal 20.

The electrical connection relationship between the number of M driving electrodes 10 and the number of N signal terminals 20 may be that the n-th signal terminal 20 may be electrically connected to the number of (a*N+n) driving electrodes 10. "n" may be a positive integer; and $n \leqslant N$. "a" may be a natural number; and $a*N+n \leqslant M$.

Controlling the movement of a liquid droplet may include at least three moving time periods TX. In each of the moving time period TX, driving signals may be respectively provided to the N signal terminals 20.

The moving time period TX may include N sub-time periods, which may be sequentially numbered from the first sub-time period to the N-th sub-time period. At an x-th sub-time period, only the x-th signal terminal 20 may be supplied with the driving signal. "x" is a positive integer; and $x \leqslant N$.

In the driving method, only N signal terminals 20 may be used to move the liquid droplet between the M driving electrodes 10. Further, the moving process of the liquid droplet may be divided into at least three moving time periods TX; and in each moving time period TX, the time sequence of the electrical signals of the N signal terminals 20 may be the same.

In one embodiment, for illustrative purposes, that M=9, N=3, and A=3 is used as an example for the description. In one moving time period TX, three sub-time periods may be set; and may be sequentially numbered as the first sub-time period t31 to the third sub-time period t33. In the first sub-time period t31, the driving signal may only be supplied to the first signal terminal 201; and the non-driving signals may be supplied to the remaining two signal terminals: the second signal terminal 202 and the third signal terminal 203. In the second sub-time period t32, the driving signal may only be supplied to the second signal terminal 202. In the third sub-time period t33, the driving signal may only be supplied to the third signal terminal 203.

The time periods TX may be repeated, and the liquid droplet may be continuously driven to move to a predetermined position. For each signal terminal, the pulse signal may be regular, and the interval between any two adjacent pulses may be the same. For N signal terminals, it may be only necessary to provide a set of regular pulse signals to each signal terminal, respectively, to provide electrical signals to the number of M driving electrodes to drive the liquid droplet to move.

In some embodiments, there may be more driving electrodes in the microfluidic chip. For example, when the number of the driving electrodes is 30, the disclosed driving method may still be used for driving the liquid droplet to move.

Figure 12:
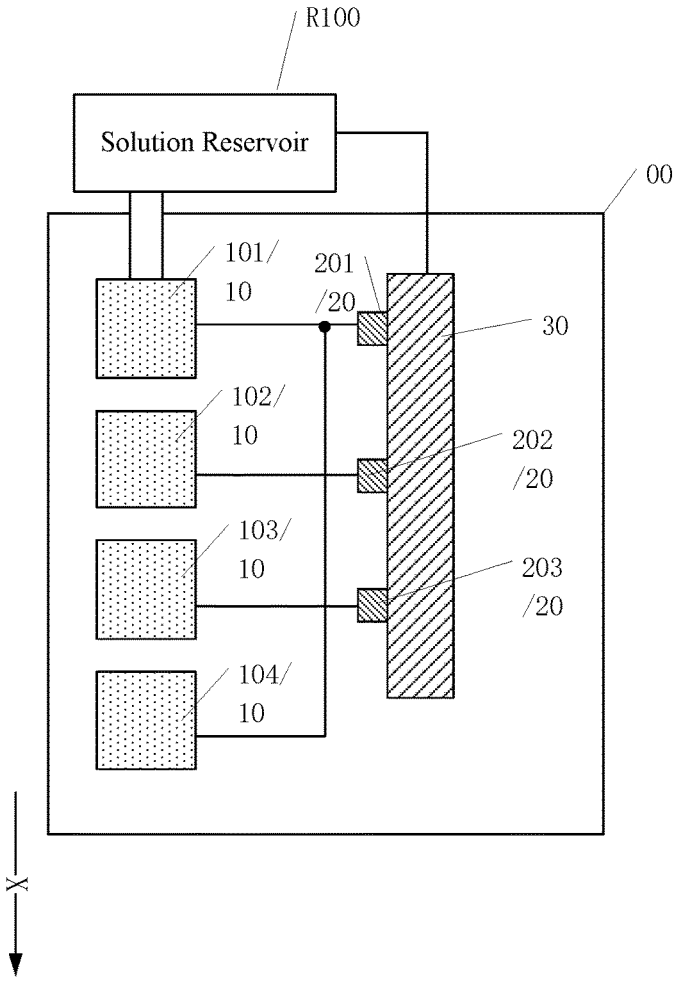
FIG. 12 illustrates an exemplary analysis apparatus consistent with various disclosed embodiments.

The present disclosure also provides an analysis apparatus. The analysis apparatus may include the disclosed microfluidic chip (s) and/or other appropriate microfluidic chip. FIG. 12 illustrates an exemplary analysis apparatus consistent with various disclosed embodiments.

As shown in FIG. 12, the analysis apparatus may include a disclosed microfluidic chip, and a solution reservoir R100. The microfluidic chip may obtain a liquid droplet from the solution reservoir R100.

Referring to FIG. 9 and FIG. 12, in one embodiment, the liquid droplet may be stored in the solution reservoir R100; and the signal processing chip 30 may be electrically connected to the solution reservoir R100. When the signal processing chip 30 provides a signal to the solution reservoir R100 during the first time period t11, such as a low level signal, while the signal processing chip 30 may provide a driving signal to the first driving electrode 101 and the fourth driving electrode 104, such as a high level signal, the liquid droplet may be moved from the solution reservoir R100 to the first driving electrode 101. In other time periods, the signal processing chip 30 may provide driving signals to the driving electrodes through the signal terminals to move the liquid droplet to the preset positions; and the solution reservoir R100 may be kept at the low level status.

In some embodiments, the signal processing chip may also be disposed on the base substrate 00, or a flexible circuit board, or a PCB board; and then may be connected to the signal terminals through connection lines. The configuration of the signal processing chip is not limited by the present disclosure.

Further, the solution reservoir and the driving electrodes may be connected to a same driving chip, or different driving chips. The configuration of the solution reservoir and the driving electrodes is not limited by the present disclosure.

The analysis apparatus may have the beneficial effects of the disclosed microfluidic chips. The details may be referred to the previous description of the disclosed microfluidic chips.

The disclosed microfluidic chip and the method for driving the microfluidic chip and the analysis apparatus may have at least the following beneficial effects.

The microfluidic chip may include a number of M driving electrodes and a number of N signal terminals. The signal terminals and the driving electrodes may be electrically connected to provide electrical driving signals to the driving electrodes. The number of M driving electrodes and the number of N signal terminals may have a specific electrical connection relationship which may reduce the number of signal terminals. Any three adjacent driving electrodes may be electrically connected to different signal terminals, respectively; and at least two driving electrodes may be electrically connected to a same signal terminal, and M>N. The electrical driving signal may be supplied to at least two driving electrodes through one signal terminal. Thus, the number of signal terminals may be reduced; and the complexity of the electrical driving signals may be reduced; and the production cost of the microfluidic chip may be reduced.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A microfluidic chip, comprising:

a substrate;

a number of M driving electrodes disposed on a side of the substrate and arranged along a first direction; and a number of N signal terminals electrically connected to the number of M driving electrodes, wherein:

any three adjacent driving electrodes are connected to different signal terminals, respectively;

a number of A of the number of M driving electrodes are connected to a same signal terminal; and M, N and A are positive integers, and M≥4, N≥3, M>N, and A≥2.

2. The microfluidic chip according to claim 1, wherein:

at least three driving electrodes are electrically connected to a same signal terminal;

a number of B driving electrodes are disposed between two adjacent driving electrodes of the at least three driving electrodes; and B is a positive integer, and B≥2.

3. The microfluidic chip according to claim 1, wherein:

the number of M is an integer multiple of the number of N; and a same number of driving electrodes are electrically connected to each of the signal terminals.

4. The microfluidic chip according to claim 3, wherein:

the number of M driving electrodes are numbered from a first driving electrode to an M-th driving electrode along the first direction;

the number of N signal terminals are numbered from a first signal terminal to an N-th signal terminal; and an electrical connection relationship between the number of M driving electrodes and the number of N signal terminals is that an n-th signal terminal is connected to a number of (a*N+n) driving electrodes, wherein:

n is a positive integer;

n≤N;

a is a natural number; and a*N+n≤M.

5. The microfluidic chip according to claim 1, further comprising:

a signal processing chip electrically connected to the number of N signal terminals.

6. The microfluidic chip according to claim 1, further comprising:

a number of N connection lines electrically connected to the signal terminals in a one-on-one correspondence, wherein the driving electrodes electrically connected to the same signal terminal are connected to corresponding signal terminals through the connection lines.

7. The microfluidic chip according to claim 6, wherein:

the connection lines and the driving electrodes are disposed in different conductive layers.

8. The microfluidic chip according to claim 1, wherein:

the driving electrodes are square-shaped.

9. The microfluidic chip according to claim 1, wherein:

the driving electrodes are striped-shaped elongated along a second direction perpendicular to the first direction.

10. The microfluidic chip according to claim 9, wherein:

each of the driving electrodes includes at least two sub-electrodes arranged along the second direction; and the at least two sub-electrodes are electrically connected through a connection part.

11. A method for driving a microfluidic chip, comprising:

providing a microfluidic chip, including:

a substrate;

a number of M driving electrodes disposed on a side of the substrate and arranged along a first direction; and a number of N signal terminals electrically connected to the number of M driving electrodes, wherein:

any three adjacent driving electrodes are connected to different signal terminals, respectively;

a number of A of the number of M driving electrodes are connected to a same signal terminal; and M, N and A are both positive integers, and $M \geq 4$, $N \geq 3$, $M > N$, and $A \geq 2$; and using the signal terminals to provide electrical signals to the driving electrodes to drive a liquid droplet to move along the first direction, wherein a same electrical signal is provided to the number of A of driving electrodes through one signal terminal.

12. The method according to claim 11, wherein:

at least three driving electrodes are electrically connected to a same signal terminal;

a number of B driving electrodes are disposed between two adjacent driving electrodes of the at least three driving electrodes;

B is a positive integer and $B \geq 2$;

the method further includes:

using one signal terminal to provide an electrical signal to the at least three driving electrodes, wherein the electrical signal is a pulse signal and intervals between any two adjacent pulses of the pulse signal are a same.

13. The method according to claim 11, wherein:

the number of M is an integer multiple of the number of N;

a same number of the driving electrodes are electrically connected to each of the signal terminals;

the number of M driving electrodes are numbered from a first driving electrode to an M-th driving electrode along the first direction;

the number of N signal terminals are numbered from a first signal terminal to an N-th signal terminal;

an electrical connection relationship between the number of M driving electrodes and the number of N signal terminals is that an n-th signal terminal is connected to $(a*N+n)$ driving electrodes, wherein:

n is a positive integer;

$n \leq N$;

a is a natural number;

$a*N+n \leq M$;

a process for controlling a movement of the liquid droplet includes at least three moving time periods;

driving signals are provided to the number N of signal terminals respectively during three moving time periods;

the moving period includes a number of N sub-periods from a first sub-period to an N-th sub-period;

during an x-th period, the driving signal is only provided to the x-th signal terminal; and x is a positive integer and $x \leq N$.

14. The method according to claim 13, further comprising:

repeating the moving time periods until the liquid droplet is moved to a pre-determined position.

15. An analysis apparatus, comprising:

a microfluidic chip, including:

a substrate;

a number of M driving electrodes disposed on a side of the substrate and arranged along a first direction; and a number of N signal terminals electrically connected to the number of M driving electrodes, wherein:

any three adjacent driving electrodes are connected to different signal terminals, respectively:

a number of A of the number of M driving electrodes are connected to a same signal terminal; and M, N and A are positive integers, and $M \geq 4$, $N \geq 3$, $M > N$, and $A \geq 2$.

16. The analysis apparatus according to claim 15, further comprising:

a liquid reservoir for providing a liquid droplet.

17. The analysis apparatus according to claim 15, wherein:

at least three driving electrodes are electrically connected to a same signal terminal;

a number of B driving electrodes are disposed between two adjacent driving electrodes of the at least three driving electrodes; and B is a positive integer and $B \geq 2$.

18. The analysis apparatus according to claim 15, wherein:

the number of M is an integer multiple of the number of N; and a same number of the driving electrodes are electrically connected to each of the signal terminals.

19. The analysis apparatus according to claim 15, further comprising:

a signal processing chip electrically connected to the number of N signal terminals.

20. The analysis apparatus according to claim 19, further comprising:

a number of N connection lines electrically connected to the signal terminals in a one-on-one correspondence, wherein the driving electrodes electrically connected to the same signal terminal are connected to the same signal terminal through connection lines.

* * * * *